US010240757B1

(12) United States Patent
Li et al.

(10) Patent No.: US 10,240,757 B1
(45) Date of Patent: Mar. 26, 2019

(54) LIGHT APPARATUS

(71) Applicant: XIAMEN ECO LIGHTING CO. LTD., Xiamen (CN)

(72) Inventors: Ke Li, Xiamen (CN); Shouqiang Hou, Xiamen (CN); Xiaoliang Wen, Xiamen (CN); Maojin Zeng, Xiamen (CN); Xinwen Lin, Xiamen (CN); Yongji Li, Xiamen (CN)

(73) Assignee: XIAMEN ECO LIGHTING CO. LTD, Xiamen (CN)

( * ) Notice: Subject to any disclaimer, the term of this patent is extended or adjusted under 35 U.S.C. 154(b) by 0 days.

(21) Appl. No.: 15/907,276

(22) Filed: Feb. 27, 2018

(51) Int. Cl.

| | |
|---|---|
| ***F21V 14/02*** | (2006.01) |
| ***F21V 19/02*** | (2006.01) |
| ***F21V 23/00*** | (2015.01) |
| ***F21V 29/70*** | (2015.01) |
| ***F21V 5/04*** | (2006.01) |
| ***F21V 3/00*** | (2015.01) |
| ***F21V 19/00*** | (2006.01) |
| *F21Y 115/10* | (2016.01) |

(52) U.S. Cl.
CPC ..... *F21V 19/02* (2013.01); *F21V 3/00* (2013.01); *F21V 5/04* (2013.01); *F21V 14/02* (2013.01); *F21V 19/00* (2013.01); *F21V 23/003* (2013.01); *F21V 29/70* (2015.01); *F21Y 2115/10* (2016.08)

(58) Field of Classification Search
CPC . F21V 19/00; F21V 19/02; F21V 5/04; F21V 3/00; F21V 29/70; F21V 14/02; F21V 23/003
See application file for complete search history.

(56) References Cited

U.S. PATENT DOCUMENTS

| | | | | |
|---|---|---|---|---|
| 4,387,362 A * | 6/1983 | Gosswiller | B60Q 1/2611 | 340/469 |
| 5,957,562 A * | 9/1999 | Hill | A63H 33/30 | 362/253 |
| 8,928,964 B1 * | 1/2015 | Sternowski | G02F 1/01 | 359/238 |

* cited by examiner

*Primary Examiner* — Thomas M Sember
(74) *Attorney, Agent, or Firm* — Chun-Ming Shih

(57) ABSTRACT

A light apparatus has a light module, a housing, and a direction switch structure. The light module has a light source. The light source emits light to a light emitting side of the light module. The housing stores the light module and has a first housing side and a second housing side. The direction switch structure is used by user for switching the light emitting side facing to the first housing side or the second housing side. When the light emitting side of the light module faces to the first housing side, a first light pattern is output by the light apparatus. When the light emitting side of the light module faces to the second housing side, a second light pattern is output by the light apparatus. The first light pattern and the second light pattern have different light characteristics.

20 Claims, 7 Drawing Sheets

LIGHT APPARATUS

FIELD OF INVENTION

The present invention is related to a light apparatus and more particularly related to a light apparatus that have multiple statuses.

BACKGROUND

There are various light devices in daily life. In modern society, light devices are an important symbol as well as tools to support today's civilization growing.

Some light devices are fixed in the ceiling like downlight devices. Some are placed on table, and some other light devices are used for various working needs. For example, a photographer needs various light devices to create a desired luminous environment. Some light devices need to be portable to be conveniently moved and placed in working environments.

Innovative light devices might not appear important as they are. But it is helpful to enhance human life when various novel light devices are invented and provided to the world. Such innovation may be on decreasing manufacturing cost, adding features, or making light devices more portable or with more functions.

Therefore, it is beneficial to continue find out innovative light designs in such crowded art. Any innovation advancement may bring certain advancement of this society, by finding new design, new technical problems and new technical solutions to bring new products.

SUMMARY OF INVENTION

According to an embodiment of the present invention, a light apparatus is provided. The light apparatus has a light module, a housing, and a direction switch structure.

The light module has a light source. The light source emits light to a light emitting side of the light module. There are various ways to implement the light module that can be used in this invention.

For example, the light module may include a light plate mounted with LED module, a driver circuit for converting battery power or external power to driving current to drive the LED module to emit light, a heat sink for helping removing heat generated by the LED module and the driver circuit, and necessary structure to fixing these components together.

The housing is used for storing the light module and has a first housing side and a second housing side. In other words, the light module is completely or partly contained in a containing space defined by the housing. The housing may have different shapes, including closure type, half-closure type or multiple-part type. For example, the housing may be a box with two opposite sides open as the first housing side and the second housing side as mentioned above.

The direction switch structure is used for switching the light emitting side of the light module facing to the first housing side or the second housing side. Specifically, as mentioned above, the light module may be stored in a containing space of the housing. In addition to stay in the containing space, the light module may change its direction with respect to the housing with the direction switch structure.

One example of such direction switch structure is using a rotation shaft and corresponding structure to allow the light module to rotate with respect to the housing. When the first housing side and the second housing sides are two opposite sides of the housing, the light module may need to rotate for 180 degrees to change its light emitting side from facing the first housing side to the second housing side, and vice versa.

The direction switch structure does not need to be limited to rotation structure. For example, the direction switch structure may include a track for detaching the light module from the housing and then places the light module back into the track with its light emitting side facing to the other side of the housing.

In addition, the rotation structure may have a pair located in two lateral sides of the housing. Alternatively, the rotation structure may have a pair located on top side and bottom side of the housing, with a different rotation manner.

Therefore, there are various manners persons of ordinary skilled in the art may choose, in light of the disclosure and teaching of this specification and are supposed to fall within the invention scopes, too.

When the light emitting side of the light module faces to the first housing side, a first light pattern is output by the light apparatus. When the light emitting side of the light module faces to the second housing side, a second light pattern is output by the light apparatus. The first light pattern and the second light pattern having different light characteristics.

In other words, the light module may be selected to switch its light emitting side to facing either the first housing side or the second housing side to change overall output light characteristics. For example, when the light emitting side of the light module is facing to the first housing side, the first light pattern may be a light beam with a narrower beam angle. On the other hand, when the light emitting side of the light module is facing to the second housing side, the second light pattern may be soft light without narrow condensed light beam effect.

With such design, the same light module may be used to provide two or more than two light effects. When the light apparatus is portable, e.g. to be carried by users to place in different locations, such feature is more helpful because users do not need to carry multiple light devices for different light requirement. In contrast, users may bring the same portable light apparatus and by simple adjustment of the direction switch structure, the light apparatus may provide multiple light features satisfying different needs during working of users.

In some embodiments, the direction switch structure is a rotation structure for rotating the light module with respect to the housing. The rotation structure may include a shafts and corresponding slots. In such case, the shafts may be disposed on two sides of the light module and the corresponding slots are placed in the inner side of the housing.

There are, of course, other variations, like to place the slots in the light module and to keep the shaft on the housing. There are various known rotation structure that may also be applied in such embodiments, in addition to the shaft to slot structure mentioned here.

In addition, a stop structure may be provided to keep the light module to stay robustly in either facing the first housing side or the second housing side. For example, an elastic clip with an associated cavity to receive the elastic clip may be used to remain the light module to stay in stable status unless an external is again applied to change the direction of the light module with respect to the housing.

In some embodiments, the first housing side and the second housing side are two opposite sides of the housing. Alternatively, the first housing and the second housing side do not need to stay at opposite side. For example, the housing is a box structure, and the first housing side and the second housing side are two neighboring sides of the box structure. In other words, if there is a rotation applied for switching the light module from facing the first housing side to the second housing side, 90 degree, instead of 180 degree, rotation may be sufficient.

In some embodiments, the light module is rotated for 180 degrees with respect to the housing for changing the light emitting direction from the first housing side to the second housing side.

In some embodiments, there may be a rotation bar on the external surface of the housing so that users may handle the rotation bar to operate the rotation structure connected to the rotation bar to switch the light module direction, either facing to the first housing side or the second housing side.

In some embodiments, the rotation bar is a U shape structure with two ends connecting to a rotation shaft of the rotation structure. In other words, users may conveniently carry such light apparatus by holding the horizontal bar of the U shape structure. By rotating the U shape structure, it is also convenient and saves force with lever rule.

In some embodiments, the light module has a lens for condensing light emitted from the light source to form a light beam. For example, a lens is placed above a light plate for directing light emitted from the light plate to a desired direction or forming a desired pattern, e.g. with a half intensity angle of less than 120 degrees.

In addition, the light module may be integrated as a water proof module for safety or other reason. In such case, the first housing side may have nothing, simply to provide an opening for light to pass through to form the first light pattern.

Alternatively, to prevent dust or water entering the light apparatus, a transparent cover may be disposed to cover the first housing side.

In some embodiments, the first housing side, instead of having nothing, may have a slot structure for replacing and holding different optical components, like color filter, condensing lens, diffusion cover, etc. to further affect and change the final first light pattern.

The term light pattern used here may refer to various optical characteristic, e.g. half intensity angle, condensed or diffused manner, colors, color temperatures, luminous level. For example, the first light pattern may correspond to a light beam with a half intensity angle less than 120 degrees.

In some embodiments, the second housing side may have a diffusion cover so that when a light is emitted from the light module passing through the diffusion cover, the second light pattern is formed and the second light pattern has a larger half intense angle than the first light pattern.

In some other embodiments, the second housing side has a lens for condensing light of the light module to form the second light pattern.

As mentioned above, the housing may have various shapes. For example, the housing has a box shape with two opposite sides as the first housing side and the second housing side respectively.

In some embodiments, the light source has a driver circuit to adjust parameters of the light source by reference to which of the first housing side and the second housing side the light emitting side being faced to. For example, when the direction switch structure, like a rotation shaft, is operated, a trigger device may be disposed to detect which housing side the light emitting direction of the light module is now facing to. The trigger device, which may be a mechanical structure or an electronic sensor, informs the driver to adjust driving parameters of the light source.

For example, a portion of LED modules on the light source may be set to only emit light when the light emitting side of the light source facing to one predetermined side from the first housing side and the second housing side. In such case, the LED modules of the light source may be classified into two partially overlapped groups to be turned on or turned off according to which housing side the light module is facing to. Luminous level, blinking or not, or how dimmer is supposed to adjust the light module, all may be considered and adopted to meeting different design needs.

In some embodiments, the light module has a battery to drive the light source to emit light. In such case, the light apparatus may be portable, e.g. less than 50 cm width and height.

In some embodiments, an electricity wire is routed to a connector connecting to an external power source via a rotation shaft as the direction switch structure. Metal clips or other conductive routing may be used. The rotation shaft, if being used as the direction switch structure, is kept connecting the light module and the housing. Therefore, it is convenient to route electricity, e.t. to recharging the battery in the light module via such electricity route from a socket of the housing.

In addition, the heat may be broadcasted and transmitted from the light module to the housing. For example, the light module may have a heat sink that is further directly or indirectly connected to the housing to pass heat from the light module to the housing to enhance life span of the light module.

In addition to two housing sides to be selected for the light module to face to, there may be more than three housing sides to be selected and deployed with different optical components to generate more light patterns. For example, the housing may be a box structure, having six sides to be used. Four housing sides may be disposed with different components to generate four different light patterns even all originated from the same light source. In such case, a rotation of 90 degrees may move to another light pattern.

DETAILED DESCRIPTION

Figure 1:
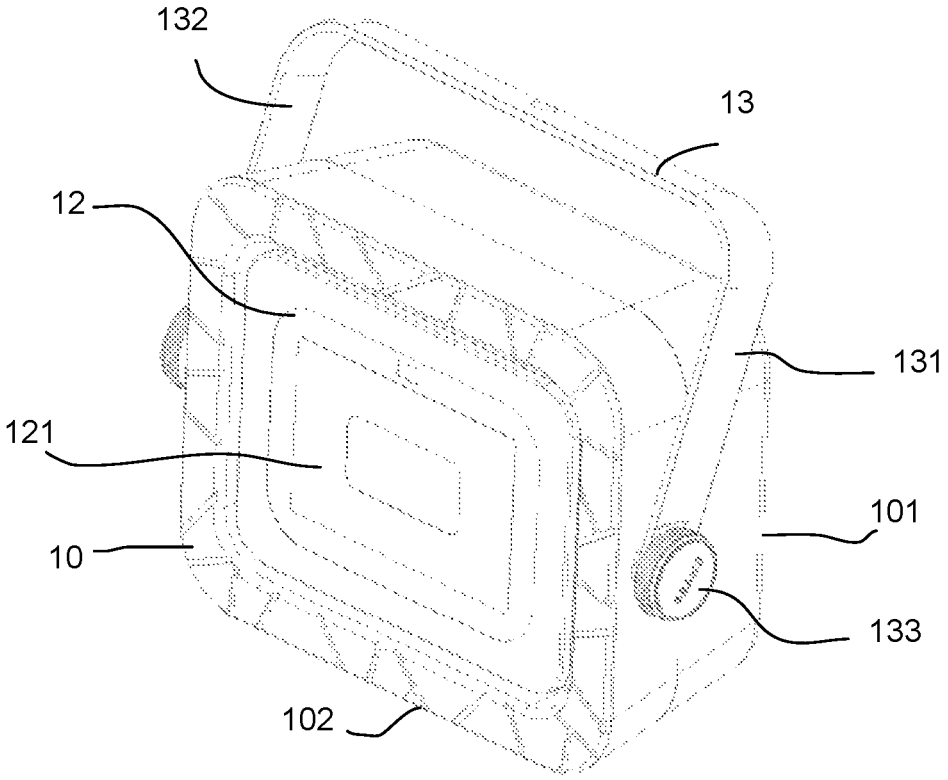
FIG. 1 illustrates an embodiment of a light apparatus.

According to an embodiment of the present invention, a light apparatus is provided. The light apparatus has a light module, a housing, and a direction switch structure.

The light module has a light source. The light source emits light to a light emitting side of the light module. There are various ways to implement the light module that can be used in this invention.

For example, the light module may include a light plate mounted with LED module, a driver circuit for converting battery power or external power to driving current to drive the LED module to emit light, a heat sink for helping removing heat generated by the LED module and the driver circuit, and necessary structure to fixing these components together.

The housing is used for storing the light module and has a first housing side and a second housing side. In other words, the light module is completely or partly contained in a containing space defined by the housing. The housing may have different shapes, including closure type, half-closure type or multiple-part type. For example, the housing may be a box with two opposite sides open as the first housing side and the second housing side as mentioned above.

The direction switch structure is used for switching the light emitting side of the light module facing to the first housing side or the second housing side. Specifically, as mentioned above, the light module may be stored in a containing space of the housing. In addition to stay in the containing space, the light module may change its direction with respect to the housing with the direction switch structure.

One example of such direction switch structure is using a rotation shaft and corresponding structure to allow the light module to rotate with respect to the housing. When the first housing side and the second housing sides are two opposite sides of the housing, the light module may need to rotate for 180 degrees to change its light emitting side from facing the first housing side to the second housing side, and vice versa.

The direction switch structure does not need to be limited to rotation structure. For example, the direction switch structure may include a track for detaching the light module from the housing and then places the light module back into the track with its light emitting side facing to the other side of the housing.

In addition, the rotation structure may have a pair located in two lateral sides of the housing. Alternatively, the rotation structure may have a pair located on top side and bottom side of the housing, with a different rotation manner.

Therefore, there are various manners persons of ordinary skilled in the art may choose, in light of the disclosure and teaching of this specification and are supposed to fall within the invention scopes, too.

When the light emitting side of the light module faces to the first housing side, a first light pattern is output by the light apparatus. When the light emitting side of the light module faces to the second housing side, a second light pattern is output by the light apparatus. The first light pattern and the second light pattern having different light characteristics.

In other words, the light module may be selected to switch its light emitting side to facing either the first housing side or the second housing side to change overall output light characteristics. For example, when the light emitting side of the light module is facing to the first housing side, the first light pattern may be a light beam with a narrower beam angle. On the other hand, when the light emitting side of the light module is facing to the second housing side, the second light pattern may be soft light without narrow condensed light beam effect.

With such design, the same light module may be used to provide two or more than two light effects. When the light apparatus is portable, e.g. to be carried by users to place in different locations, such feature is more helpful because users do not need to carry multiple light devices for different light requirement. In contrast, users may bring the same portable light apparatus and by simple adjustment of the direction switch structure, the light apparatus may provide multiple light features satisfying different needs during working of users.

In some embodiments, the direction switch structure is a rotation structure for rotating the light module with respect to the housing. The rotation structure may include a shafts and corresponding slots. In such case, the shafts may be disposed on two sides of the light module and the corresponding slots are placed in the inner side of the housing.

There are, of course, other variations, like to place the slots in the light module and to keep the shaft on the housing. There are various known rotation structure that may also be applied in such embodiments, in addition to the shaft to slot structure mentioned here.

In addition, a stop structure may be provided to keep the light module to stay robustly in either facing the first housing side or the second housing side. For example, an elastic clip with an associated cavity to receive the elastic clip may be used to remain the light module to stay in stable status unless an external is again applied to change the direction of the light module with respect to the housing.

In some embodiments, the first housing side and the second housing side are two opposite sides of the housing. Alternatively, the first housing and the second housing side do not need to stay at opposite side. For example, the housing is a box structure, and the first housing side and the second housing side are two neighboring sides of the box structure. In other words, if there is a rotation applied for switching the light module from facing the first housing side to the second housing side, 90 degree, instead of 180 degree, rotation may be sufficient.

In some embodiments, the light module is rotated for 180 degrees with respect to the housing for changing the light emitting direction from the first housing side to the second housing side.

In some embodiments, there may be a rotation bar on the external surface of the housing so that users may handle the rotation bar to operate the rotation structure connected to the rotation bar to switch the light module direction, either facing to the first housing side or the second housing side.

In some embodiments, the rotation bar is a U shape structure with two ends connecting to a rotation shaft of the rotation structure. In other words, users may conveniently carry such light apparatus by holding the horizontal bar of the U shape structure. By rotating the U shape structure, it is also convenient and saves force with lever rule.

In some embodiments, the light module has a lens for condensing light emitted from the light source to form a light beam. For example, a lens is placed above a light plate for directing light emitted from the light plate to a desired direction or forming a desired pattern, e.g. with a half intensity angle of less than 120 degrees.

In addition, the light module may be integrated as a water proof module for safety or other reason. In such case, the first housing side may have nothing, simply to provide an opening for light to pass through to form the first light pattern.

Alternatively, to prevent dust or water entering the light apparatus, a transparent cover may be disposed to cover the first housing side.

In some embodiments, the first housing side, instead of having nothing, may have a slot structure for replacing and holding different optical components, like color filter, condensing lens, diffusion cover, etc. to further affect and change the final first light pattern.

The term light pattern used here may refer to various optical characteristic, e.g. half intensity angle, condensed or diffused manner, colors, color temperatures, luminous level. For example, the first light pattern may correspond to a light beam with a half intensity angle less than 120 degrees.

In some embodiments, the second housing side may have a diffusion cover so that when a light is emitted from the light module passing through the diffusion cover, the second light pattern is formed and the second light pattern has a larger half intense angle than the first light pattern.

In some other embodiments, the second housing side has a lens for condensing light of the light module to form the second light pattern.

As mentioned above, the housing may have various shapes. For example, the housing has a box shape with two opposite sides as the first housing side and the second housing side respectively.

In some embodiments, the light source has a driver circuit to adjust parameters of the light source by reference to which of the first housing side and the second housing side the light emitting side being faced to. For example, when the direction switch structure, like a rotation shaft, is operated, a trigger device may be disposed to detect which housing side the light emitting direction of the light module is now facing to. The trigger device, which may be a mechanical structure or an electronic sensor, informs the driver to adjust driving parameters of the light source.

For example, a portion of LED modules on the light source may be set to only emit light when the light emitting side of the light source facing to one predetermined side from the first housing side and the second housing side. In such case, the LED modules of the light source may be classified into two partially overlapped groups to be turned on or turned off according to which housing side the light module is facing to. Luminous level, blinking or not, or how dimmer is supposed to adjust the light module, all may be considered and adopted to meeting different design needs.

In some embodiments, the light module has a battery to drive the light source to emit light. In such case, the light apparatus may be portable, e.g. less than 50 cm width and height.

In some embodiments, an electricity wire is routed to a connector connecting to an external power source via a rotation shaft as the direction switch structure. Metal clips or other conductive routing may be used. The rotation shaft, if being used as the direction switch structure, is kept connecting the light module and the housing. Therefore, it is convenient to route electricity, e.t. to recharging the battery in the light module via such electricity route from a socket of the housing.

In addition, the heat may be broadcasted and transmitted from the light module to the housing. For example, the light module may have a heat sink that is further directly or indirectly connected to the housing to pass heat from the light module to the housing to enhance life span of the light module.

In addition to two housing sides to be selected for the light module to face to, there may be more than three housing sides to be selected and deployed with different optical components to generate more light patterns. For example, the housing may be a box structure, having six sides to be used. Four housing sides may be disposed with different components to generate four different light patterns even all originated from the same light source. In such case, a rotation of 90 degrees may move to another light pattern.

Figure 2:
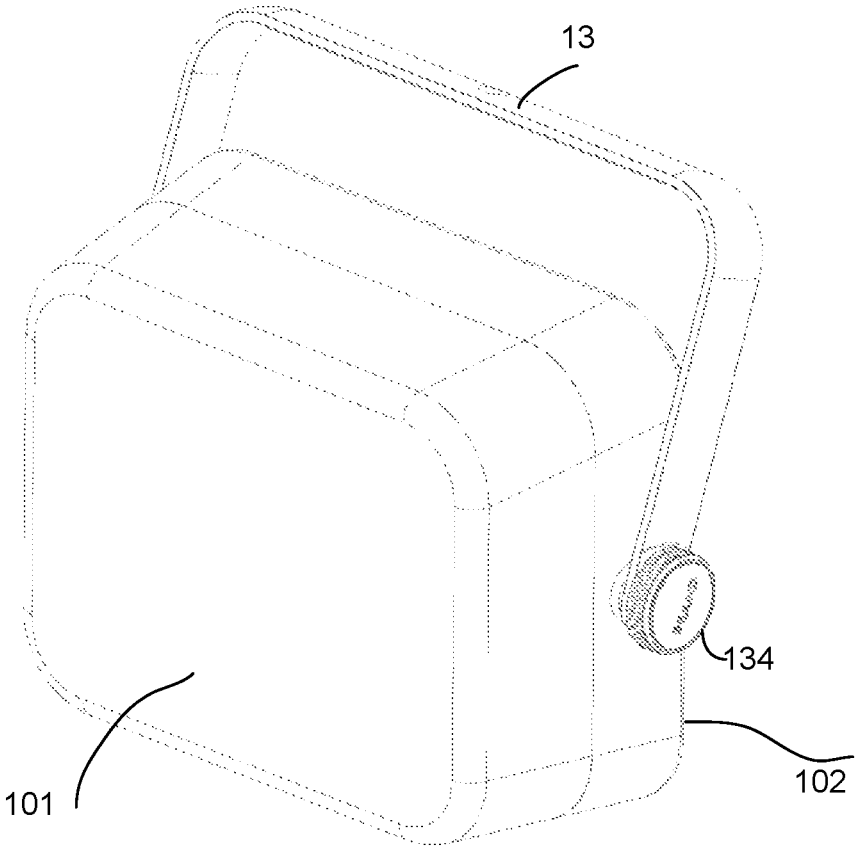
FIG. 2 illustrates another view of the embodiment of FIG. 1.

Please refer to FIG. 1 and FIG. 2, which illustrates an embodiment of a light apparatus.

In FIG. 1 and FIG. 2, the light apparatus has a housing that has a first housing side 102 and a second housing side 101. An U-shape bar, as mentioned above, may be used to carry and to rotate a rotation structure connecting a light module 12 and the housing.

The light module 12 has a lens 121 for condense light emitted from a LED plate, e.g. to keep the half intensity angle within 120 degrees. A rotation structure 133 may be connected to an inner rotation structure as a direction switch structure for rotating the light module 12 with respect to the housing. The U-shape bar has two arms respectively connected to two rotation structures 133 and 134.

Figure 3:
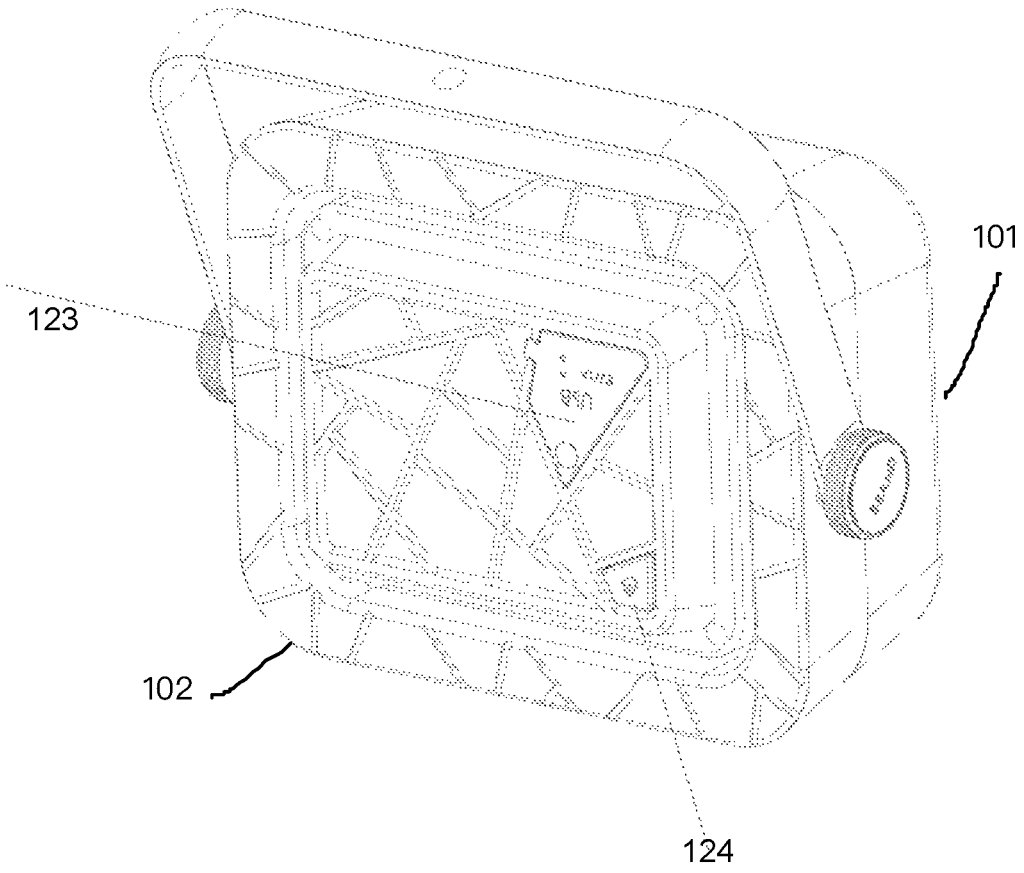
FIG. 3 illustrates another operation status of the embodiment of FIG. 1.

Please refer to FIG. 3, which illustrates another status when the light module is facing to the second housing side 101, while exposing its backside to the first housing side 102. In such status, a USB socket 123 and a power-on switch 124 may be operated by a user to recharge the light module, to turn on or to turn off the light module.

Figure 4:
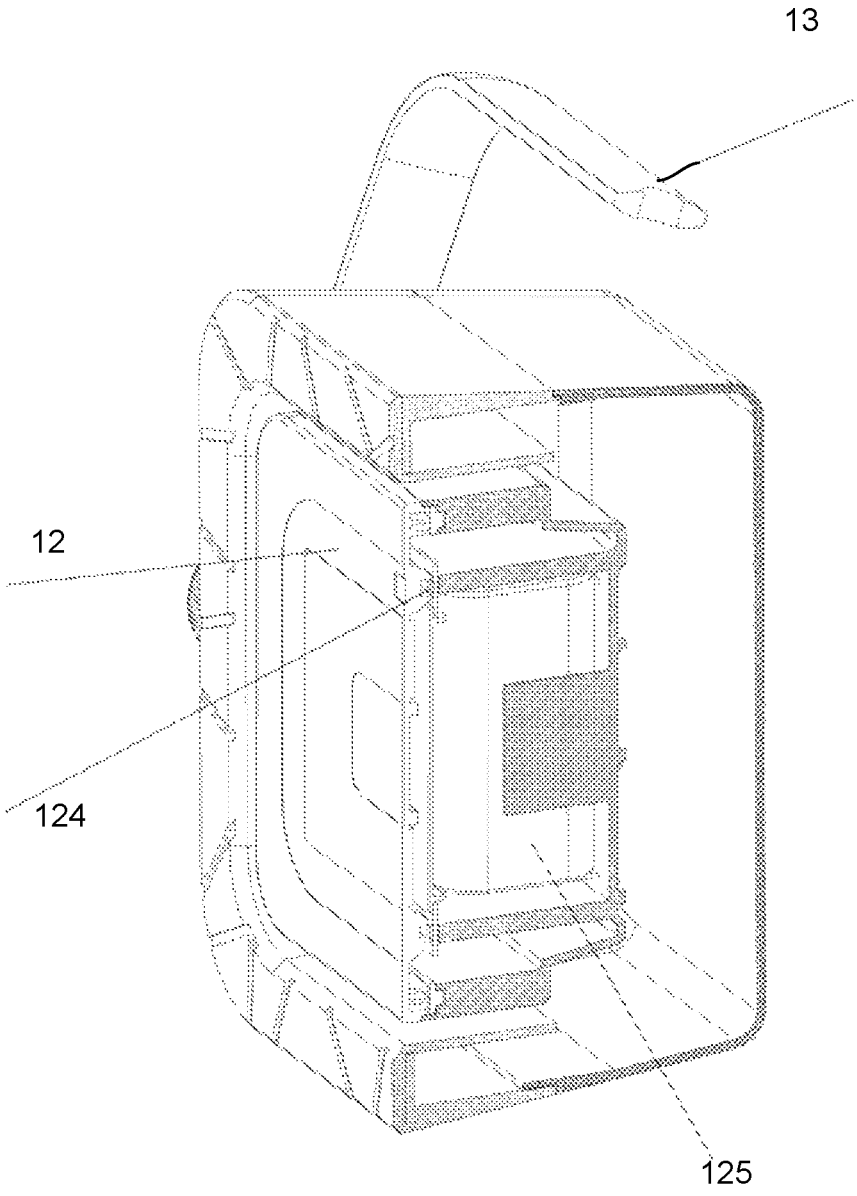
FIG. 4 illustrates a cross-sectional view of components of the embodiment of FIG. 1.

FIG. 4 illustrates a cross-sectional view of components of this embodiment. It is more clear in FIG. 4, that the light module 12 has a light plate 124 mounted with LED modules. A heat sink housing 125 and driver circuits therein are used for heat dissipation and driving current generation. In other words, the light module itself forms an independent module that may emit light.

In this embodiment, the light module 12 may be rotated to change its light emitting side facing to the first housing side or the second housing side.

Figure 5:
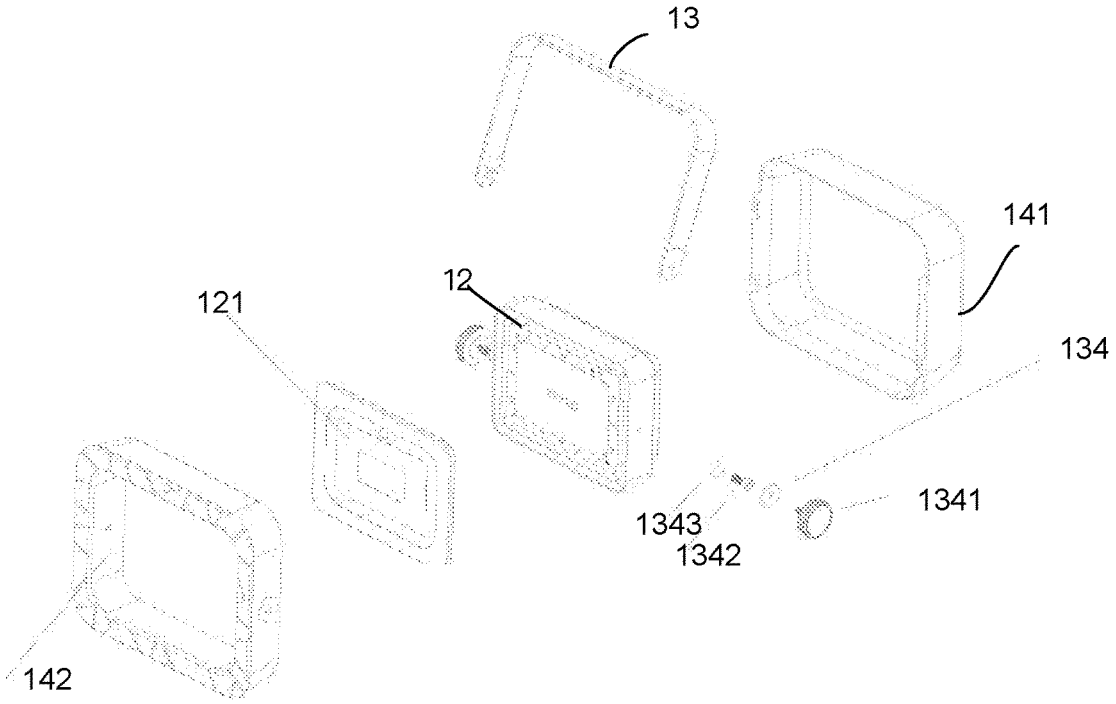
FIG. 5 illustrates an exploded view of components of the embodiment of FIG. 1.
Figure 6:
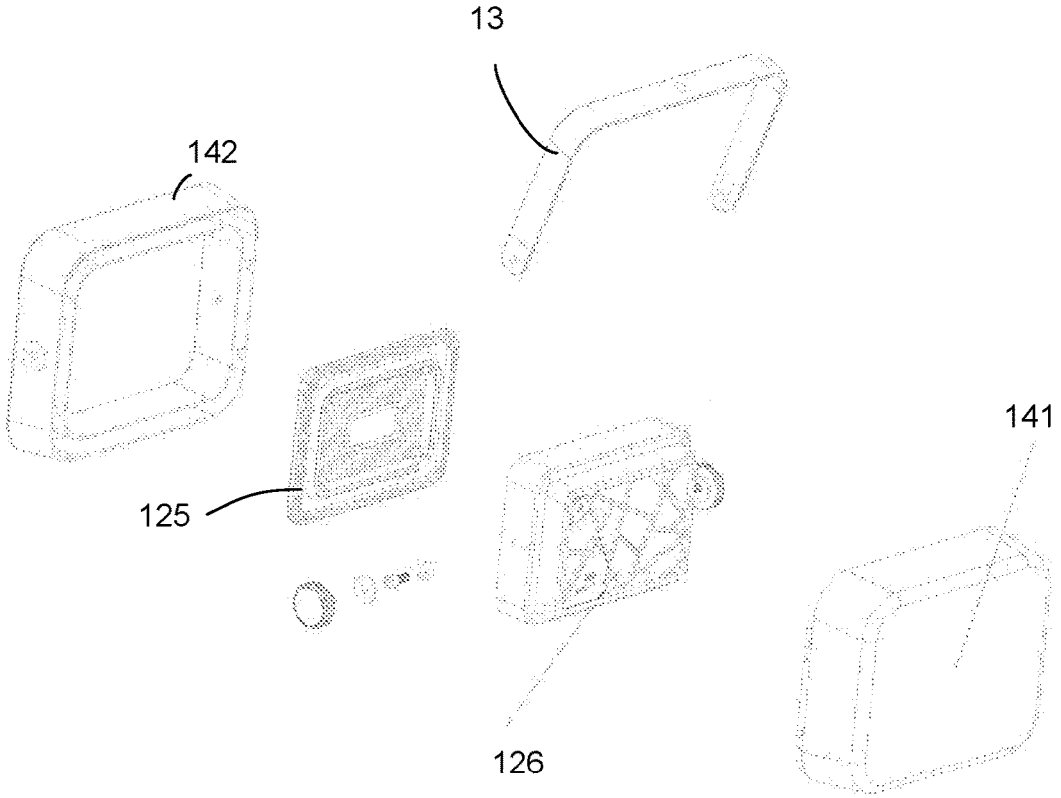
FIG. 6 illustrates another exploded view of components of the embodiment of FIG. 1.

FIG. 5 and FIG. 6 further illustrates components of this embodiment in more details. In addition to the U-shape bar 13, there is a diffusion cover 141 disposed at the second housing side and a frame defining an opening disposed at the first housing side.

A lens 121 is used for condense light emitted from the light module 12. The rotation structure 134 has several components 1341, 1342, 1343 together for providing rotation mechanism of the embodiment. A heat sink 126 and a light plate 125 are provided to make the light module more complete.

However, please be noted that this embodiment is used for exemplary purpose, not to limit the scope of the invention.

Figure 7:
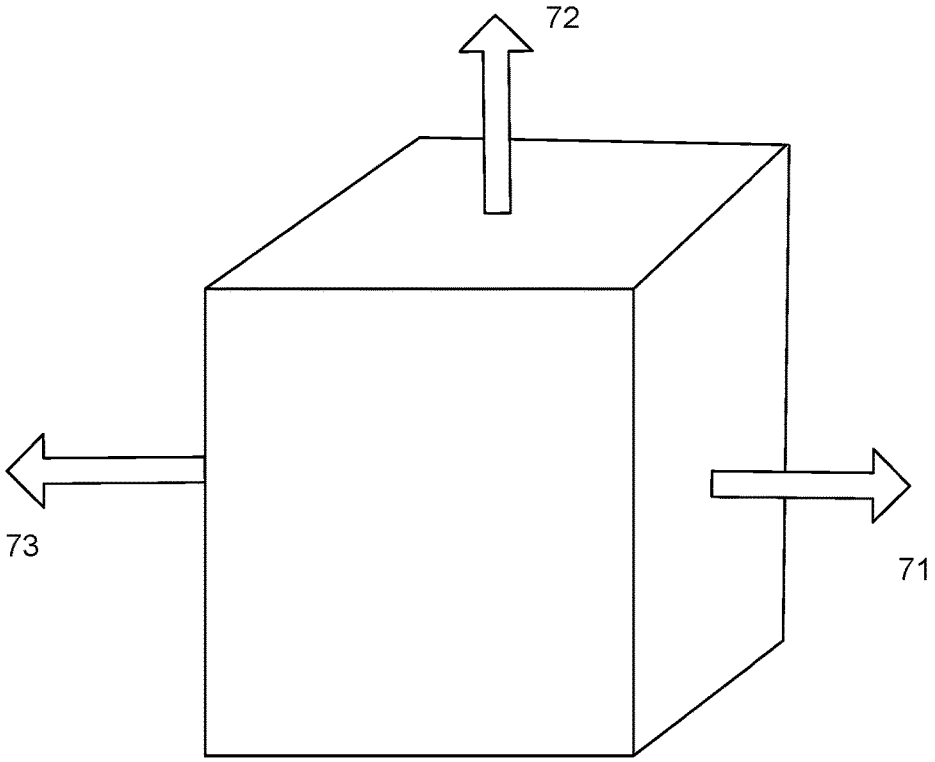
FIG. 7 illustrates another embodiment.

For example, in FIG. 7, which illustrates a housing having three options 71, 72 and 73 for a light module to face to. On facing different sides, the final output light may have three different light patterns, e.g. different color, different half intensity angle, or even different color.

Other variations, with above disclosure in text, persons of ordinary skilled in the art are supposed to understand the spirit of the invention, including various implementation methods. They may choose and modify the design to meet different design needs.

In addition to the above-described embodiments, various modifications may be made, and as long as it is within the spirit of the same invention, the various designs that can be made by those skilled in the art are belong to the scope of the present invention.

The invention claimed is:

1. A light apparatus comprising:

a light module with a light source, the light source emitting light to a light emitting side of the light module;

a housing for storing the light module and having a first housing side and a second housing side; and a direction switch structure for switching the light emitting side of the light module facing to the first housing side or the second housing side, when the light emitting side of the light module facing to the first housing side, a first light pattern being output by the light apparatus, when the light emitting side of the light module facing to the second housing side, a second light pattern being output by the light apparatus, the first light pattern and the second light pattern having different light characteristics.

2. The light apparatus of claim 1, wherein the direction switch structure is a rotation structure for rotating the light module with respect to the housing.

3. The light apparatus of claim 2, wherein the first housing side and the second housing side are two opposite sides of the housing.

4. The light apparatus of claim 3, wherein the light module is rotated for 180 degrees with respect to the housing for changing the light emitting direction from the first housing side to the second housing side.

5. The light apparatus of claim 2, further comprising a rotation bar for users to operate the rotation structure to rotate the light module with respect to the housing.

6. The light apparatus of claim 5, wherein the rotation bar is a U shape structure with two ends connecting to a rotation shaft of the rotation structure.

7. The light apparatus of claim 1, wherein the light module has a lens for condensing light emitted from the light source to form a light beam.

8. The light apparatus of claim 7, wherein the first housing side has an opening for light out of the lens of the light module to form the first light pattern.

9. The light apparatus of claim 1, further comprising a transparent cover attached to the first housing side to prevent external object entering a rotation space of the light module in the housing.

10. The light apparatus of claim 1, wherein a slot structure is provided at the first housing side of the housing for replacing one from candidate optical components in the slot structure as a factor to determine the first light pattern.

11. The light apparatus of claim 7, wherein the first light pattern is a light beam with a half intensity angle less than 120 degrees.

12. The light apparatus of claim 1, wherein the second housing side has a diffusion cover so that when a light emitted from the light module passing through the diffusion cover, the second light pattern is formed and the second light pattern has a larger half intense angle than the first light pattern.

13. The light apparatus of claim 1, wherein the second housing side has a lens for condensing light of the light module to form the second light pattern.

14. The light apparatus of the claim 1, wherein the housing has a box shape with two opposite sides as the first housing side and the second housing side respectively.

15. The light apparatus of claim 1, wherein the light source has a driver circuit to adjust parameters of the light source by reference to which of the first housing side and the second housing side the light emitting side being faced to.

16. The light apparatus of claim 1, wherein a portion of LED modules on the light source only emit light when the light emitting side of the light source facing to one predetermined side from the first housing side and the second housing side.

17. The light apparatus of claim 1, wherein the light module has a battery to drive the light source to emit light.

18. The light apparatus of claim 1, wherein an electricity wire is routed to a connector connecting to an external power source via a rotation shaft as the direction switch structure.

19. The light apparatus of claim 1, wherein the light module has a heat sink for conducing heat from the light source to the housing.

20. The light apparatus of claim 1, wherein there is a third housing side for being selected to face the light emitting side of the light module.

* * * * *